US005120432A

United States Patent [19]

Bornengo et al.

[11] Patent Number: 5,120,432

[45] Date of Patent: Jun. 9, 1992

[54] PROCESS FOR THE SELECTIVE FLOTATION OF METAL ORES USING 2-MERCAPTOTHI-AZOLE DERIVATIVES

[75] Inventors: Giorgio Bornengo, Novara; Anna Marabini, Frascati; Vittorio Alesse, Rome, all of Italy

[73] Assignee: Consiglio Nazionale Delle Ricerche, Rome, Italy

[21] Appl. No.: 641,779

[22] Filed: Jan. 16, 1991

[51] Int. Cl.[5] ..... B03D 1/012; B03D 1/018; B03D 1/02; B03D 1/06

[52] U.S. Cl. ..... 209/166; 209/167; 252/61

[58] Field of Search ..... 209/166, 167, 901; 252/61

[56] References Cited

U.S. PATENT DOCUMENTS

| | | | |
|---|---|---|---|
| 1,652,060 | 12/1927 | Smith | 209/167 |
| 1,780.000 | 10/1930 | Bolton | 209/166 |
| 1,806,362 | 5/1931 | Moses | 209/166 |
| 1,807.859 | 6/1931 | Moses | 209/166 |
| 1,847,664 | 3/1932 | Ney | 209/166 |
| 1,852,107 | 4/1932 | Christmann | 209/166 |
| 1,858,007 | 5/1932 | Falconer | 209/166 |
| 4,601,818 | 7/1986 | Bresson | 209/166 |
| 4,724,072 | 2/1988 | Bornengo | 209/167 |
| 4,946,585 | 8/1990 | Lambert | 209/166 |

*Primary Examiner*—Peter Hruskoci
*Assistant Examiner*—Thomas M. Lithgow
*Attorney, Agent, or Firm*—Oliff & Berridge

[57] ABSTRACT

A process for the selective flotation of metal ores is described, wherein ionic organic collectors are utilized, which have the formula:

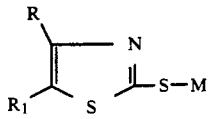

(I)

where R and $R_1$, like or different from each other, represent: H, a halogen, a straight or branched $C_{1-9}$ alkyl group, an alkoxyl or hydroxyalkyl group in which the alkyl moiety contains from 1 to 9 carbon atoms, or a phenyl group; and M represents: H, Na, K, Li, Cs, $NH_4$.

7 Claims, No Drawings

PROCESS FOR THE SELECTIVE FLOTATION OF METAL ORES USING 2-MERCAPTOTHI-AZOLE DERIVATIVES

BACKGROUND OF THE INVENTION

The present invention relates to a process for the flotation of metal ores, in particular of ores containing copper, zinc, lead and silver.

As is known, the flotation techniques utilize compounds capable of causing a selective flotation of the ores to be separated (reference is made in this connection to Italian patent applications Nos. 48687 A/84, 48585 A/84 and 48019 A/85).

The collectors utilized or known so far are divided into two classes: ionic collectors and non-ionic collectors.

The use of oily or neutral non-ionic collectors is generally limited to the flotation of non-polar ores, while the ionizable collectors are utilized for all the other ore species, on the surface of which they are adsorbed with substantially chemical bonds.

The problems raised by a flotation process are particularly complex when the purpose is that of separating a certain ore from a mixture of ores belonging to a same class; in such a case, in fact, it is necessary to use modifying compounds which cause the action of the collector to become more specific.

However, the use of such reagents often involves serious difficulties without giving the desired results, particularly in the case of ores having a complex chemical composition, the surface properties of which are not sufficiently known.

Thus, it is particularly important to have available collecting agents capable of selectively binding themselves to certain ores, limiting incorporations of waste materials and therefore permitting a high recovery of the desired material in a highly concentrated state.

DETAILED DESCRIPTION OF THE INVENTION

The present invention describes a process for the flotation of copper, zinc, lead, silver ores, wherein the selective collector consists of mercaptothiazoles of formula:

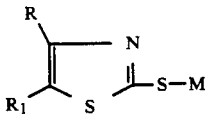

(I)

wherein:

R and $R_1$, like or different from each other, represent: H, a halogen, a straight or branched $C_{1-9}$ alkyl group, an alkoxyl or hydroxyalkyl group in which the alkyl moiety contains from 1 to 9 carbon atoms, or a phenyl group; and M represents: H, Na, K, Li, Cs, $NH_4$.

Said collectors prove to be particularly suited to the flotation of ores containing the above said metals and in particular: chalcopyrite, chalcocite, covellite, blende, galena, tetrahedrite, smithsonite, Ag ores.

The surprising marked selectivity of the above-defined collectors for the cited metals is illustrated by the data indicated in the examples. As one can see, the properties of the flotative agents according to the present invention are better than the ones of the common collectors which are known in the particular field of use taken into consideration.

The process which utilizes the new flotative agents according to the invention provides particularly advantageous results when it is conducted in a pH range from 4 to 12 and in particular from 6 to 10 and using a collector concentration of 25–300 mg/kg with respect to the ore to be floated; in these conditions, the metal is practically fully recovered.

In order to make the process according to the present invention more easily reproduceable, the preparation of a few flotative agents, and of the corresponding salts, which are useful in the embodiment of the invention, is described hereinafter.

PREPARATION 1

Preparation of a collector of formula:

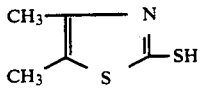

24 Parts of ammonium dithiocarbamate were added to 50 parts of water. Under stirring and at a temperature of about 25° C., 21.2 parts of methylperchloroethyl ketone dissolved in 55 parts of ethanol were dropped thereinto in 40 minutes. The mixture was heated to about 60° C. in 4 hours (the reaction trend checked by means of thin-layer chromatography). On conclusion of the reaction, the reacted mass was cooled to room temperature and the product was extracted with ether. After distillation of the solvent, the product was crystallized from water. The product was dried in oven under vacuum at a temperature of about 60° C.; 24.3 parts of dry product were obtained.

PREPARATION 2

Preparation of a collector of formula:

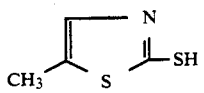

24 Parts of ammonium dithiocarbamate were added to 50 parts of monoglyme. Under stirring and at a temperature of about 35° C., 20.35 parts of chloroacetone were dropped thereinto in 60 minutes. The mixture was heated to 60° C. during 4 hours (the reaction trend was checked by means of thin-layer chromatography). The unreacted monoglyme was distilled under vacuum. After distillation of the solvent, the product was crystallized from water. It was dried at 45° C. in oven under vacuum; 17.6 parts of dry product were obtained.

PREPARATION 3

Preparation of a flotation collector of formula:

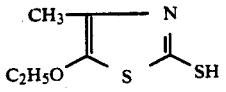

24 Parts of ammonium dithiocarbamate were added to 100 parts of ether. Under stirring and at a temperature of 20° C., 30 parts of perchloro-α-ethoxy-acetone dissolved in 50 parts of ether were dropped thereinto in 50 minutes. The whole was heated at reflux for 6 hours (about 35° C.). On conclusion of the reaction, it was cooled down to room temperature and 50 parts of water were added. The ethereal phase was separated and the solvent was distilled. After ether distillation, the product was crystallized from water/ethanol (mixture ratio=8/2 parts). The product was dried at 40° C. in oven under vacuum. 24.1 parts of dry product were obtained.

PREPARATION 4

Preparation of a flotation collector of formula:

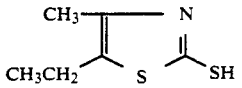

24 Parts of ammonium dithiocarbamate were added to 50 parts of water. Under stirring and at a temperature of about 30° C., 26.5 parts of alpha-chloropropylmethylketone dissolved in 55 parts of methanol were dropped thereinto in 30 minutes. The mixture was heated to about 60° C. during 4 hours.

On conclusion of the reaction, the reacted mass was cooled to room temperature and the product was extracted with ether.

After distillation of the solvent, the product was crystallized from water. The product was dried in oven under vacuum at a temperature of about 55° C.; 23.2 parts of product were obtained.

In order to illustrate, but not to limit, the process according to the present invention, a few examples of the process carried out with specific products are given hereinafter.

General conditions, which are common to all the given examples:

Grinding: 1 kg of ore mixed with one liter of water was introduced into a laboratory bar mill and was ground until 80% of the ore reached sizes below 75 microns. The product, after it was taken out from the mill, was placed into a 2.5 l flotation cell, then, under stirring, the reagents were added and allowed to react for 2 minutes, whereafter, after addition of Aerofroth 65 as a foaming agent, the ore was subjected to flotation during 5 minutes.

EXAMPLE 1

Ore based on sulphides, containing 3.2% of Cu prevailingly in the form of chalcopyrite ($CuFeS_2$) and 9.05% of Fe, about 3% thereof in the chalcopyrite and the remaining portion prevailingly as pyrite ($FeS_2$).

Collector: 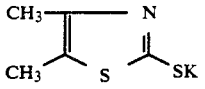

Dosage: 30 mg/kg
Foaming agent: 30 mg/kg
pH: 9.5

| | Weight % | Cu content % | Cu recovery % |
|---|---|---|---|
| Floated | 21.67 | 15.01 | 92.32 |
| Waste | 78.33 | 0.33 | 7.68 |

EXAMPLE 2

The same ore as in Example 1.

Collector: 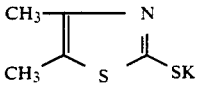

Dosage: 25 mg/kg
Foaming agent: 30 mg/kg
pH: 9.5

| | Weight % | Cu content % | Cu recovery % |
|---|---|---|---|
| Floated | 14 | 19.84 | 76.17 |
| Waste | 86 | 1.01 | 23.83 |

EXAMPLE 3

The same ore as in Example 1.

Collector: 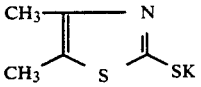

Dosage: 25 mg/kg
Foaming agent: 30 mg/kg
pH: 7.1

| | Weight % | Cu content % | Cu recovery % |
|---|---|---|---|
| Floated | 12.07 | 20.16 | 73.46 |
| Waste | 87.93 | 1.0 | 26.54 |

EXAMPLE 4

The same ore as in Example 1.

Collector: 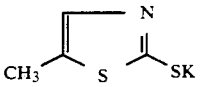

Dosage: 30 mg/kg
Foaming agent: 30 mg/kg
pH: 7.3

| | Weight % | Cu content % | Cu recovery % |
|---|---|---|---|
| Floated | 14.77 | 17.49 | 76.33 |
| Waste | 85.23 | 0.94 | 23.67 |

EXAMPLE 5

The same ore as in Example 1.

Collector: 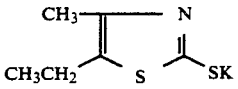

Dosage: 30 mg/kg
Foaming agent: 30 mg/kg
pH: 7.3

| | Weight % | Cu content % | Cu recovery % |
|---|---|---|---|
| Floated | 16.03 | 16.98 | 83.52 |
| Waste | 83.97 | 0.64 | 16.48 |

EXAMPLES 6-7-8

Ore based on sulphides containing: 2.20% of Pb prevailingly as galena (PbS), 5.76% of Zn prevailingly as blende (ZnS), 18.49% of Fe as siderite ($FeCO_3$) and pyrite ($FeS_2$). In this case, in order to obtain a successive separation of lead and zinc, there were added, as reagents, $Na_2CO_3$ and $ZnSO_4$, which had the function of depressing the blende flotability, and, subsequently to the collection of lead, $CuSO_4$ was added, which reactivated the flotativeness thereof.

Grinding: 80% of the ore having size below 74 microns.

Reagents common to all the examples:

| | | | |
|---|---|---|---|
| $Na_2CO_3$ | 200 mg/kg | Reaction time | 3 minutes |
| $ZnSO_4$ | 300 mg/kg | " | 5 minutes |
| Collector | 40 mg/kg | " | 2 minutes |
| Aerofroth 65 frother | 30 mg/kg | " | 1 minute |

Reagents utilized for the flotation of the zinc ores:

| | | | |
|---|---|---|---|
| $CuSO_4$ | 300 mg/kg | Reaction time | 5 minutes |
| Collector | 70 mg/kg | " | 2 minutes |
| Aerofroth 65 frother | 20 mg/kg | " | 1 minute |

EXAMPLE 6

Collector

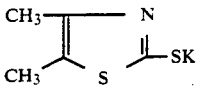

Dosage: 40 mg/kg in the flotation of Pb, 70 mg/kg in the flotation of Zn

| | Weight % | Pb cont. % | Pb rec. % | Zn cont. % | Zn rec. % |
|---|---|---|---|---|---|
| Floated Pb | 18.07 | 8.28 | 65.45 | 4.52 | 14.54 |
| Floated Zn | 18.65 | 3.35 | 27.33 | 18.20 | 60.44 |
| Waste | 63.28 | 0.25 | 6.92 | 2.22 | 25.02 |

EXAMPLE 7

Collector

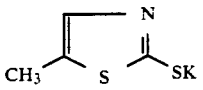

Dosage: 40 mg/kg in the flotation of Pb, 70 mg/kg in the flotation of Zn

| | Weight % | Pb cont. % | Pb rec. % | Zn cont. % | Zn rec. % |
|---|---|---|---|---|---|
| Floated Pb | 8.57 | 14.20 | 59.72 | 3.72 | 5.94 |
| Floated Zn | 18.85 | 3.2 | 29.60 | 18.48 | 64.87 |
| Waste | 72.58 | 0.3 | 10.68 | 2.16 | 29.19 |

EXAMPLE 8

Collector

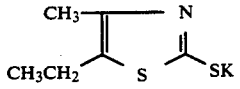

Dosage: 40 mg/kg in the flotation of Pb, 70 mg/kg in the flotation of Zn

| | Weight % | Pb cont. % | Pb rec. % | Zn cont. % | Zn rec. % |
|---|---|---|---|---|---|
| Floated Pb | 10.12 | 11.99 | 54.65 | 4.78 | 8.59 |
| Flotated Zn | 16.02 | 5.41 | 38.89 | 23.25 | 66.22 |
| Waste | 70.86 | 0.2 | 6.37 | 2.0 | 25.19 |

In order to better evaluate the selectivity of the present compounds as compared with the one of the known selectors, the values obtained in a flotation test with potassium ethyl xanthate [EtOC(=S)SK] for the flotation of a copper ore are indicated hereinafter:

| | | |
|---|---|---|
| collector: | potassium ethyl xanthate | |
| dosage: | 30 mg/kg | |
| foaming agent: | 30 mg/lg | |
| pH: | 7.3 | |

| | Weight % | Cu content % | Cu recovery % |
|---|---|---|---|
| Floated | 15 | 16.1 | 72.1 |
| Waste | 85 | 1.1 | 27.9 |

We claim:

1. A process for the selective flotation of mineral ores wherein said mineral ores are selected from the group consisting of copper, zinc, lead and silver ores comprising subjecting at least one of said mineral ores to selective flotation in the presence of a sufficient amount of a mineral flotation collector to selectively concentrate the minerals in a float fraction, wherein said mineral flotation collector comprises a compound having the formula:

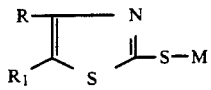

where R represents H, a halogen, a straight or branched $C_{1-9}$ alkyl group, an alkoxyl group or hydroxyalkyl group in which the alkyl moiety contains from 1 to 9 carbon atoms, or a phenyl group; $R_1$ represents a halogen, a straight or branched $C_{1-9}$ alkyl group, an alkoxyl group or hydroxyalkyl group in which the alkyl moiety contains from 1 to 9 carbon atoms, or a phenyl group; and M represents H, Na, K, Li, Cs, $NH_4$.

2. A process according to claim 1, wherein the ores subjected to flotation are selected from the group consisting of chalcopyrite, chalcocite, covellite, blende, galena, tetrahedrite, and smithsonite.

3. A process according to claim 1, wherein said flotation is conducted at a pH from 4 to 12.

4. A process according to claim 3, wherein the pH range is from 6 to 10.

5. A process according to claim 1, wherein the collector concentration ranges from 25 to 300 mg/kg based on the treated ore weight.

6. A process according to claim 1, wherein the selective flotation in succession of lead and zinc contained in an ore as PbS and ZnS respectively, comprises the steps of:

(a) adding said flotation collector to a flotation cell containing said ore and also adding $Na_2CO_3$ and $ZnSO_4$ to depress ZnS flotativeness;

(b) subjecting said lead and zinc ore to said selective flotation and selectively collecting lead from the float fraction;

(c) adding $CuSO_4$ to the ZnS remaining in the cell to reactivate the ZnS flotativeness.

7. A process for the selective flotation of mineral ores, wherein said mineral ores are selected from the group consisting of copper, zinc, lead and silver ores comprising subjecting at least one of said mineral ores to selective flotation in the presence of a sufficient amount of a mineral flotation collector to selectively concentrate said minerals in a float fraction, wherein said mineral flotation collector comprises a compound having the formula:

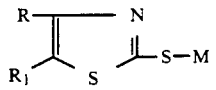

where R represents a halogen, a straight or branched $C_{1-9}$ alkyl group, an alkoxyl group or hydroxyalkyl group in which the alkyl moiety contains from 1 to 9 carbon atoms, or a phenyl group; $R_1$ represents a halogen, a straight or branched $C_{1-9}$ alkyl group, an alkoxyl group or hydroxyalkyl group in which the alkyl moiety contains from 1 to 9 carbon atoms, or a phenyl group; and M represents H, Na, K, Li, Cs, $NH_4$.

* * * * *

UNITED STATES PATENT AND TRADEMARK OFFICE

CERTIFICATE OF CORRECTION

PATENT NO. : 5,120,432

DATED : June 9, 1992

INVENTOR(S) : Giorgio Bornengo, Anna Marabini and Vittorio Alesse

It is certified that error appears in the above-identified patent and that said Letters Patent is hereby corrected as shown below: Title page, item [54], and col. 1, lines 1-3, Change "PROCESS FOR THE SELECTIVE FLOTATION OF METAL ORES USING 2-MERCAPTOTHI-AZOLE DERIVATIVES" to --PROCESS FOR THE SELECTIVE FLOTATION OF METAL ORES USING 2-MERCAPTOTHIAZOLE DERIVATIVES--.

Signed and Sealed this

Thirteenth Day of July, 1993

*Attest:*

Michael K. Kirk

MICHAEL K. KIRK

*Attesting Officer*

*Acting Commissioner of Patents and Trademarks*